United States Patent [19]

Whispell

[11] Patent Number: 4,462,171

[45] Date of Patent: Jul. 31, 1984

[54] INFLATABLE SOLE CONSTRUCTION

[76] Inventor: Louis J. Whispell, 4418 SE. 75th Ave., Portland, Oreg. 97206

[21] Appl. No.: 383,254

[22] Filed: May 28, 1982

[51] Int. Cl.[3] ..... A43B 7/06; A43B 13/20

[52] U.S. Cl. ..... 36/3 B; 36/29

[58] Field of Search ..... 36/15, 28, 29, 71, 35 B, 36/3 B

[56] References Cited

U.S. PATENT DOCUMENTS

| | | | |
|---|---|---|---|
| 1,041,185 | 10/1912 | Spitz et al. | 36/15 |
| 2,981,010 | 4/1961 | Aaskov | 36/15 |
| 4,229,889 | 10/1980 | Petrosky | 36/28 |
| 4,364,186 | 12/1982 | Fukvoka | 36/29 |

FOREIGN PATENT DOCUMENTS

| | | | |
|---|---|---|---|
| 2460034 | 6/1976 | Fed. Rep. of Germany | 36/29 |
| 2709478 | 9/1978 | Fed. Rep. of Germany | 36/29 |

*Primary Examiner*—Werner H. Schroeder
*Assistant Examiner*—Steven N. Meyers
*Attorney, Agent, or Firm*—Kolisch, Hartwell, Dickinson & Anderson

[57] ABSTRACT

A compartmentalized, variable cushioning sole construction in footwear having a top attached to an inner sole. The construction includes an outer sole and a flexible wall structure joining the peripheral edges of the inner and outer soles to form an enclosed space therebetween. This space is partitioned into fluid-tight, independently inflatable compartments corresponding to the heel, arch and ball regions of a foot. Resilient support structure in each of the compartments provides resilient weight support between the inner and outer soles when the compartments are deflated.

6 Claims, 4 Drawing Figures

INFLATABLE SOLE CONSTRUCTION

BACKGROUND AND SUMMARY OF THE INVENTION

The present invention relates to footwear construction, and more particularly, to a sole construction having independently inflatable compartments.

Footwear having one or more in fluid-inflatable sole compartments is known in the prior art. One sole construction, typified by U.S. Pat. No. 3,120,712 to Menken, includes an insole and an outsole which are joined at their peripheral edge regions by a relatively wide supporting wall member. The elongate inflatable space formed between the two soles contains a rubber bladder which is inflatable to a desired sole cushion pressure. Alternatively, the sole construction may include a pair of longitudinally spaced and independently inflatable sole compartments corresponding to heel and ball foot regions as disclosed in U.S. Pat. No. 2,605,560 to Gouabault and U.S. Pat. No. 508,034 to Moore.

A characteristic of such sole constructions known in the prior art is that the inflatable sole regions are substantially uncushioned with the air compartments deflated, such as might occur by air leakage. The deflated compartments would then be felt as uncushioned pockets in the sole, producing foot fatigue and discomfort over an extended period of wear.

One object of the present invention is to provide, in a sole construction having a plurality of independently inflatable compartment, elastomeric support members in the compartments for providing auxiliary cushioning.

Another object of the invention is to provide such a sole construction having an independently inflatable compartment corresponding to the arch region of a foot.

Yet another object of the invention is to provide, in such a sole construction, an interchangeable tread sole.

The sole construction of the present invention provides localized variable cushioning in footwear having a top attached to an inner sole. The construction includes an outer sole and a flexible wall structure joining the peripheral edges of the inner and outer soles to form an enclosed space therebetween. This space is partitioned into fluid-tight inflatable compartments corresponding substantially to the heel, arch and ball regions of a foot. The compartments are independently inflatable to desired fluid pressures by suitable valving associated with each of the compartments. Resilient support members in the compartments provide cushioning weight support between the inner and outer soles when associated compartments are in fully or partially deflated conditions.

In one embodiment of the invention, the support members are constructed to receive fasteners used in fastening an interchangeable tread sole to the outer sole in the construction.

These and other objects and features of the present invention will become more fully apparent when the following detailed description of preferred embodiments of the invention is read in conjunction with the accompanying drawings.

DETAILED DESCRIPTION OF PREFERRED EMBODIMENTS OF THE INVENTION

Figure 1:
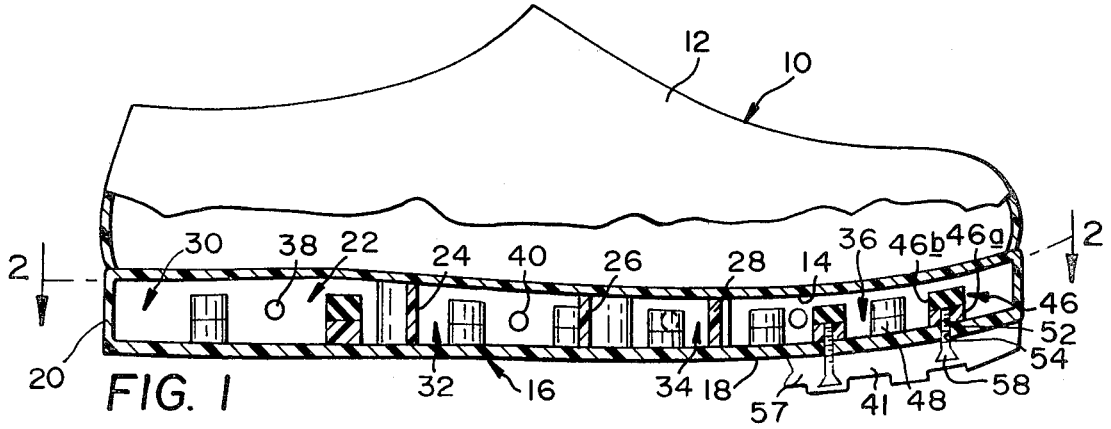
FIG. 1 is a side, partially sectional view of footwear having an inflatable sole construction formed according to one embodiment of the invention.
Figure 2:
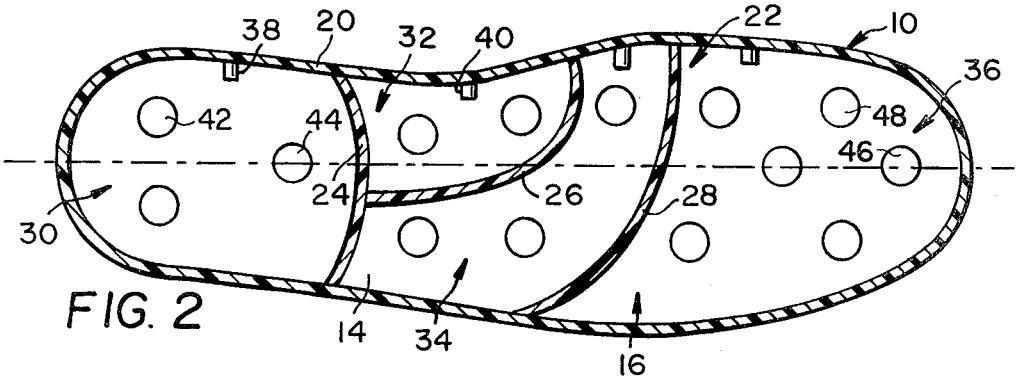
FIG. 2 is a sectional view taken generally along line 2—2 in FIG. 1.

Looking now at the figures, and particularly at FIGS. 1 and 2, there is shown generally at 10 a shoe, or footwear, having the usual top 12 and an inner sole 14 attached to the top by conventional seaming or the like. The inner sole, which is shown in plan view in FIG. 2, is formed of a conventional flexible leather or polymeric sheet material.

A sole construction formed according to one embodiment of the invention is shown generally at 16 in FIGS. 1 and 2. The construction includes an outer sole 18 having roughly the same planar shape and dimensions as inner sole 14 and formed of a like material. The two soles are joined along their peripheral edges by a flexible wall, or wall portion 20, forming an enclosed space 22 between the two soles. Wall 20 may be formed integrally with one or both of soles 14, 18, or may be suitably bonded or seamed to the soles.

Also joined to and extending between soles 14, 18 are three inner walls 24, 26, 28. These walls, like wall 20, are constructed of flexible sheet material, and may be either integrally formed with, or suitably bonded to the two soles. As seen in FIG. 2, the inner walls partition space 22 into four compartments, 30, 32, 34, 36 corresponding roughly to the heel, arch, instep and ball regions of a foot, respectively. The four compartments are sealed by a conventional air-impermeable sealant material, such as a rubber film sealant. Alternatively, each compartment may be provided with an inflatable rubber sac (not shown).

The just-described parts of the sole construction partitioning space 22 into separately inflatable fluid-tight compartments are also referred to herein, collectively, as partitioning means. Each of the compartments is preferably inflatable to a maximum pressure of about 20 psi. When fully inflated as shown in FIG. 1, the compartments have a preferred thickness of between about one-half and one inch, although smaller or greater sole thicknesses are contemplated in the invention.

The four compartments are independently inflatable, to different desired fluid pressures, by valve means associated with each compartment. One preferred type of valve means includes a self-closing rubber-tube valve of the type used widely in sports balls, and which receives a pump needle by forced insertion. Valves associated with compartments 30, 32 are indicated at 38, 40, respectively, in FIGS. 1 and 2.

According to an important feature of the present invention, the sole construction includes support means for providing resilient weight support between inner and outer soles when the compartments are in deflated conditions. The support means in the embodiment illustrated in FIGS. 1 and 2 includes resilient support members, such as members 42, 44 in compartment 30 and members 46, 48 in compartment 36. One preferred arrangement of the support members in the sole construction is shown in FIG. 2. Each member, such as member 46, takes the form of a cylindrical post which is suitably bonded to or formed with the upper surface of sole 18 and dimensioned to extend partway between the two soles when the associated compartment is fully inflated, as shown in FIG. 1. In the embodiment illustrated, where the fully inflated sole compartments have an actual thickness of about one-half inch, the spacing between the support members' upper surfaces and the confronting surface of the inner sole is preferably between about one-eighth and one-fourth inches.

Member 46, which is representative, is composed of a substantially rigid lower disc portion 46*a* formed preferably of a rigid polymeric material. A threaded socket 52 formed in portion 46*a* communicates with the outer surface of sole 18 through an opening 54 formed in the sole (FIG. 1). A resilient upper disc portion 46*b* in member 46, having about the same thickness as portion 46*a*, is formed of an elastomeric material, such as rubber, and is suitably bonded to portion 46*b*. The upper surface of portion 46*a* is adapted to engage the lower surface of sole 14, when compartment 36 is in a deflated condition, by non-sliding contact therewith.

A tread sole 57 in the construction is detachably fastened to sole 18 by plural fasteners, such as fastener 58, threadedly received in associated support member sockets, such as socket 52 in support member 46. Sole 57 is interchangeable with new and/or other types of tread soles.

In use, each compartment in the sole construction is inflated to a desired pressure by means of a small manual air pump or the like. The pump is operated until a desired hardness—as determined, for example, by resistance to finger pressure—is achieved in the compartment being inflated. The compartments in the sole construction are inflated to produce maximum comfort or therapeutic benefit. Thus, for example, if the wearer requires greater arch support, compartment 32, corresponding to the arch region of the foot, can be made firmer than adjacent compartments 30, 34.

The pressure in the sole compartments can also be adjusted for different types of walking conditions, for example, when rough terrain is expected and overall hardness in the sole construction is desired to minimize foot fatigue. As another example, a climbing boot employing the sole construction of the invention could be made relatively stiff longitudinally when the boot is used for climbing, by fully inflating the four compartments. Deflating compartments 34, 36 somewhat would allow more longitudinal flex when the boot is used for walking.

The support members in the sole construction provide auxiliary support when the compartments are only partially inflated or if the compartments lose air pressure during use. The distribution of plural support members in each compartment insures resilient, broad-surface support between the inner and outer soles in partially or fully deflated sole compartments. The support members also function to prevent slipping between the inner and outer soles in the regions in partially or fully deflated sole compartments by virtue of substantially non-sliding contact between the support members and the inner sole's lower surface.

Figure 3:
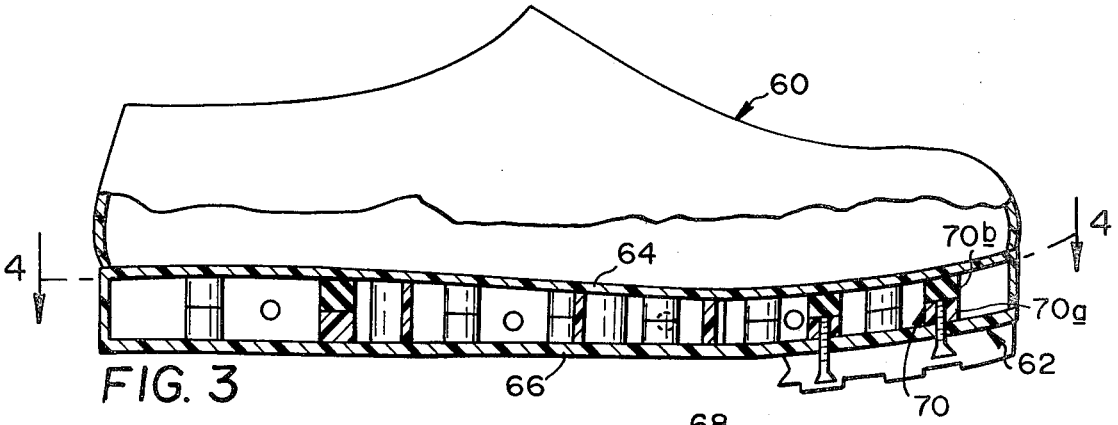
FIG. 3 is a view like FIG. 1, but showing in sectional view a second embodiment of the sole construction of the invention.
Figure 4:
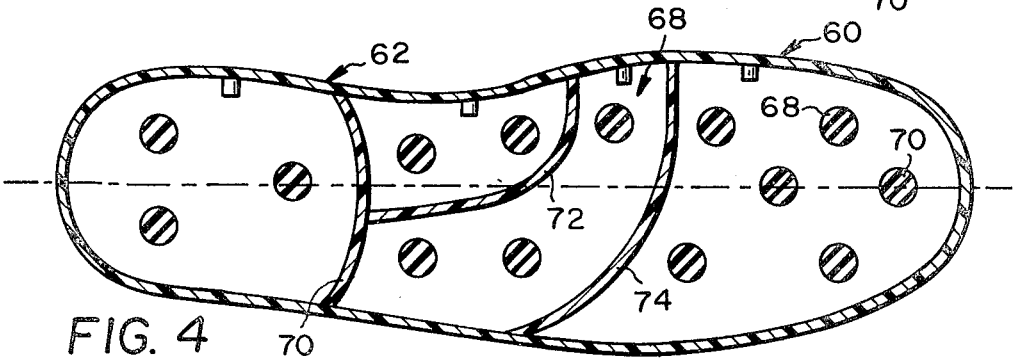
FIG. 4 is a sectional view taken generally along line 4—4 in FIG. 3.

FIGS. 3 and 4 illustrate, in views like FIGS. 1 and 2, respectively, an article of footwear 60 including a sole construction 62 formed according to a second embodiment of the invention. Construction 62 differs from construction 16 in that the resilient support members, such as members 68, 70, in the construction, extend between and are joined to the inner confronting surfaces of the inner and outer sole. The support members thus provide resilient support in the shoe both in inflated and uninflated sole compartments, with full inflation producing greater firmness in a compartment.

The construction of the support members, such as member 70, is like that of the support members in construction 16 described above. A lower rigid disc portion, such as portion 70*a* is provided with a threaded socket for receiving fasteners used in attaching a tread sole to the outer sole. An upper, resilient disc portion, such as portion 70*b*, extends between and is attached to portion 70*a* and the lower surface of the inner sole.

Both embodiments of the sole construction described above provide recognized advantages in an inflatable-sole shoe or boot. Among these advantages are greater insulation from extremes in ground temperatures, lighter shoe weight, and improved shoe cushioning. In addition to these advantages, the present invention permits variable cushioning in different regions of the foot. In particular, the invention allows the arch region of a foot to be firmly supported with respect to adjacent instep and heel regions. The construction can be made relatively rigid, in a longitudinal direction, by fully inflating all of the compartments when the shoe is used for hiking or climbing.

The support members in the two embodiments described provide resilient support between the inner and outer soles in sole regions where the compartments are partially or fully deflated. The support members also provide structural support between the inner and outer soles, as described. As a result, the wall structures joining the two soles can be made relatively lightweight and flexible.

The lower portions of the support members in the two embodiments herein provide fastener-receiving sockets distributed over the surface of the outer sole for use in fastening a detachable tread sole to the outer sole. The sole construction thus has enhanced versatility in that new or different types of thread sole can be applied to the shoe, and yet the means of attachment of a tread sole to the outer sole in no way interferes with the cushioning or support functions of either the inflatable compartments or the support members in the sole construction.

While preferred embodiments of the invention have been described herein, it will be apparent to those skilled in the art that various changes and modifications may be made without departing from the spirit of the invention.

It is claimed and desired to secure by letters patent:

1. A compartmentalized, variable cushioning sole construction in footwear having a top attached to an inner sole, said construction comprising an outer sole, a flexible wall structure joining the peripheral edges of said inner and outer soles to form an enclosed space therebetween, partition means in said enclosed space partitioning the same into fluid-tight inflatable compartments corresponding substantially to the heel, arch and ball regions of a foot, valve means associated with each of said compartments for inflating the same to a desired fluid pressure independently of the other compartments, and non-collapse support means distributed as plural free-standing posts in said compartments providing resilient weight support between said inner and outer soles when said compartments are in deflated conditions.

2. The construction of claim 1, wherein said posts take the form of compressible elastomeric members extending partway between said inner and outer soles, with the associated compartments fully inflated.

3. The construction of claim 1, wherein said posts take the form of compressible elastomeric members extending between and contacting said inner and outer soles, with the associated compartments in fully inflated condition.

4. A compartmentalized, variable cushioning sole construction in shoe having an upper shoe portion attached to an inner sole, said construction comprising an outer sole, a flexible wall structure joining the peripheral edges of said inner and outer soles to form an enclosed space therebetween, partition means in said enclosed space partitioning the same into four fluid-tight inflatable compartments corresponding substantially to the heel, arch, instep and ball regions of a foot, valve means associated with each of said compartments for inflating the same to a desired fluid pressure independently of the other compartments, non-collapse support means distributed as plural free-standing posts in said compartments providing resilient weight support between said inner and outer soles when said compartments are in deflated conditions, and a tread sole attached to said outer sole.

5. The construction of claim 4, wherein said posts take the form of compressible elastomeric members mounted on the inner side of said outer sole and extending partway between said inner and outer soles when the associated compartment is in a fully inflated condition.

6. The construction of claim 4, wherein said posts take the form of compressible elastomeric members attached to and extending between said inner and outer soles.

* * * * *